US006688075B2

(12) United States Patent
Cristina

(10) Patent No.: US 6,688,075 B2
(45) Date of Patent: Feb. 10, 2004

(54) AUTOMATIC MACHINE FOR PACKAGING PRODUCTS INSIDE CONTAINERS

(75) Inventor: Adriano Cristina, Bollate-Milan (IT)

(73) Assignee: I.A.C.E. di Cristina Adriano, Bollate-Milan (IT)

( * ) Notice: Subject to any disclaimer, the term of this patent is extended or adjusted under 35 U.S.C. 154(b) by 0 days.

(21) Appl. No.: 10/182,871

(22) PCT Filed: Feb. 7, 2001

(86) PCT No.: PCT/EP01/01311

§ 371 (c)(1),
(2), (4) Date: Aug. 1, 2002

(87) PCT Pub. No.: WO01/58762

PCT Pub. Date: Aug. 16, 2001

(65) Prior Publication Data

US 2003/0089078 A1 May 15, 2003

(30) Foreign Application Priority Data

Feb. 10, 2000 (IT) ..... MI2000A0216

(51) Int. Cl.[7] ..... B65B 1/00; B65B 3/02

(52) U.S. Cl. ..... 53/55; 53/201; 53/202; 53/50; 53/51; 53/52; 53/566

(58) Field of Search ..... 53/55, 201, 202, 53/50–52, 566

(56) References Cited

U.S. PATENT DOCUMENTS 3,258,893 A 7/1966 Jones
3,651,465 A * 3/1972 Law et al. ..... 340/5.8
4,554,777 A 11/1985 Denk et al.
5,177,930 A * 1/1993 Harston et al. ..... 53/55
5,771,657 A * 6/1998 Lasher et al. ..... 53/55
5,966,897 A * 10/1999 Kirka et al. ..... 53/55
6,050,062 A * 4/2000 Petersson et al. ..... 53/458

FOREIGN PATENT DOCUMENTS

EP 0 187 625 A1 12/1985
EP 0 957 028 A1 11/1999

OTHER PUBLICATIONS

EP Search Report.

* cited by examiner

*Primary Examiner*—Rinaldi I. Rada
*Assistant Examiner*—Michelle Lopez
(74) *Attorney, Agent, or Firm*—Hedman & Costigan, P.C.

(57) ABSTRACT

An automatic machine for packaging products, in particular cosmetic or pharmaceutical products, inside containers (11), comprising a series of stations (15–21, 21A, 21B, 21C, 23–28), in each of which the operations required to insert the products and their leaflets into containers or cartons (11), and to close the cartons (11) definitively are performed; with the machine the format of the container (11) can be changed in extremely short times and automatically, by using a keyboard to key in the parameters relevant to the dimensions of the sides (A, B, C) of the carton (11) utilised.

7 Claims, 3 Drawing Sheets

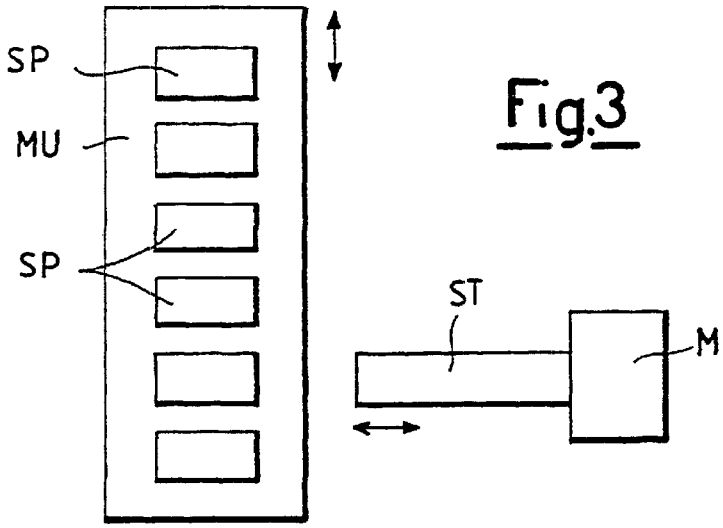
Fig.3
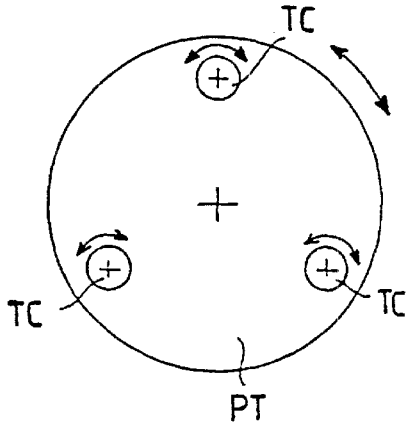
Fig.4
Fig.5
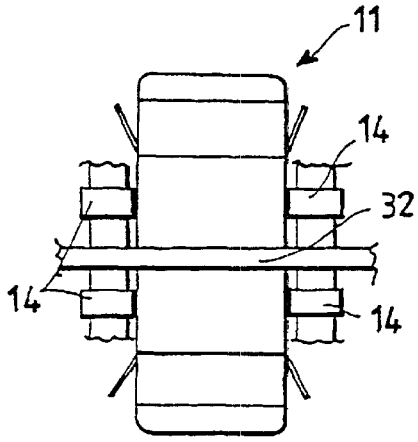
Fig.6
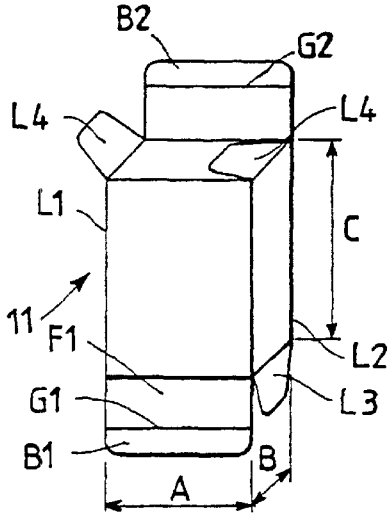

AUTOMATIC MACHINE FOR PACKAGING PRODUCTS INSIDE CONTAINERS

The present application is a §371 international application, PCT/EP01/01311, filed Feb. 7, 2001 which claims priority to Italian Patent Application Serial No. MI 2000A 000216, filed Feb. 10, 2000.

The present invention concerns a machine for packaging products in containers.

BACKGROUND OF THE INVENTION

In particular, in the course of the description, reference shall be made to a cartoning machine, suitable for inserting cosmetic or pharmaceutical products (pills, granular solutions, eye drops, creams, ointments, dissolved solutions, syrups or others), together with one or more illustrative leaflets related to the physicochemical or organoleptic composition of the product, inside containers or boxes of small or medium dimensions (cartons).

Generally, horizontal or vertical loading cartoning machines are known, on the basis of the direction in which products are inserted into packages; in any case, these usually comprise a first feed line on which the blanks of the packages into which the products are to be inserted, preformed and pressed against one another, are loaded, a second feed line with the leaflets to be inserted into the packages and a third feed line from which the products to be packaged are collected.

An in-line transfer device allows each blank, held in a vertical position and moved by one or more pairs of supporting fingers, to advance from the feed line, in order to convey it to a series of subsequent stations, by means of stepping movement of the line, so that, at each machine station, specific operations to close the blank are performed before the product and relevant illustrative leaflet are inserted inside the packet and the packet is closed.

Moreover, cartoning machines are known to have a station for the detection and elimination of rejects, usually located downstream of the station for inserting the products and illustrative leaflets into the containers, to allow automatic removal of defective items from the line (for example, due to defective containers, illustrative sheets or leaflets that are missing or do not correspond to the products inserted), which are identified by means of appropriate sensors and relevant detection devices.

One of the major problems of known cartoning machines is given by the total lack of flexibility of these machines; in fact, once the line has been programmed to handle containers of pre-set dimensions (length, width, height), each time blanks of different dimensions are loaded the machine must be stopped and regulated manually, using special equipment to adjust all distances and heights relevant to the devices for movement and support in each station, in order to adapt the instruments to the overall dimensions of the package in use.

This problem is particularly important when considering the frequent pauses in operation that are required, especially when packaging different products; moreover, operations to adjust the various devices are often inconvenient, difficult and dangerous for the personnel in charge of the machine.

Finally, for operations to open out the blank in order to detach pressed or folded portions of the package, or during closure of the upper and lower tabs of the container it is also necessary to use devices (blades) of various formats, in relation to the height of the container, which can be inserted inside the container to perform the above operations.

In this case, according to the type of container being processed, the tool magazine must be fitted with the appropriate format of blade for the specific size of the container.

SUMMARY OF THE INVENTION

The aim of the present invention is, therefore, to indicate an automatic machine for packaging products inside containers, which resolves the aforesaid problems, namely to produce an automatic machine that consents variation of the format of the containers into which the products are inserted directly in-line, without requiring to interrupt the operation of the entire machine and without needing to manually adjust the distances and heights of the various devices.

Another aim of the present invention is to indicate an automatic machine for packaging products, which permits a considerable reduction of the processing times, compared to known machines and, consequently, an increase in productivity.

A further aim of the present invention is to produce an automatic machine for packaging products inside containers, which at the same time guarantees extremely safe operating conditions for the operators.

Yet another aim of the present invention is to indicate an automatic machine for packaging products inside containers, which allows the operations for personnel in charge of the machine to be simplified compared to the known technique and which allows production costs to be decreased, using simple technologies and relatively inexpensive components, by virtue of the advantages attained.

These aims, according to the present invention are attained by producing an automatic machine for packaging products inside containers or cartons (11), comprising a plurality of stations (15–21, 21A, 21B, 21C, 23–28) in a line (13), at each of which at least one operation to package the products is performed, by means of actuators (AT, AT1, AT2 . . . ), starting from at least one blank, which is collected from a magazine (12), conveyed to a loading station (15) and transferred, according to a pre-established route (10), from one station to the next station, before being unloaded at specific reject (27) or storage (28) stations, wherein said actuators (AT, AT1, AT2 . . . ) are managed by an electronic axes control system, which automatically regulates positioning and movement of said actuators (AT, AT1, AT2 . . . ), on the basis of information relevant to at least one dimension (A, B, C) of said carton (11), which is set by an operator (OP) on an electronic processor (PC) of said axes control system, in order to allow the format of said carton (11) to be changed from a pre-established minimum value to a maximum value of overall dimensions of said carton (11) automatically, wherein said actuators (AT AT1, AT2) comprise pushing devices for said blanks and said cartons (11), inserting devices for products and illustrative leaflets, stamping devices (PT, TC) and devices for generating and printing bar codes on said cartons (11), devices to detect and process coherent codes, equipment (ST) for replacing blades (SP) that can be collected from a tool magazine (MU) and wherein said actuators (AT, AT1, AT2) move in relation to the size of said carton (11) being constructed.

Advantageously, reference is made to a particular packaging machine, namely a vertical loading cartoning machine, known to be capable of packaging products contained inside bottles or blister packs (cosmetic or pharmaceutical products) into cartons with small and medium dimensions.

In particular, the vertical loading cartoning machine, according to the invention, can be used for in-line processing of a variable number of cartons, from 100 to 100,000, without any difference whatsoever.

In addition to carrying out all operations normally performed by known vertical loading cartoning machines, it also allows variation of the format of the container being processed, simply by entering the dimensions of the sides of the container on a keyboard of an operating system which processes the data entered and sends appropriate commands, either directly or via a PLC, to an axes control device, which regulates the position and operations of all the stations of the cartoning machine.

In preferred although unlimiting forms of implementation, the operator of the cartoning machine according to the invention can change the format of the container from a minimum of 15×15×50 mm to a maximum of 120×120×250 mm, in extremely short times (up to 10 seconds) and automatically, merely by keying in the dimensions of the sides using a keyboard.

BRIEF DESCRIPTION OF THE DRAWINGS

The characteristics and advantages of an automatic machine for packaging products inside containers, according to the present invention, become more evident in the following description, relevant to an unlimiting example of a form of implementation and referring to the annexed schematic drawings, in which:

FIG. 3 is a schematic representation of a plan view of a tool magazine of an automatic machine, according to the invention, operated by the axes control system in FIG. 2;

FIG. 4 is a schematic representation of a plan view of a dry or ink jet stamp of the automatic machine according to the invention, operated by means of the axes control in FIG. 2;

FIG. 5 is a schematic front view of a device for transporting the containers in an automatic machine for packaging products, according to the invention;

FIG. 6 is a perspective view of a container or carton to be utilised in an automatic packaging machine, according to the invention.

DETAILED DESCRIPTION OF THE INVENTION

With particular reference to FIGS. 1, 5 and 6, 13 indicates generally a transport line for containers or cartons 11 of an automatic machine for packaging products, in particular of a vertical loading cartoning machine.

Figure 1:
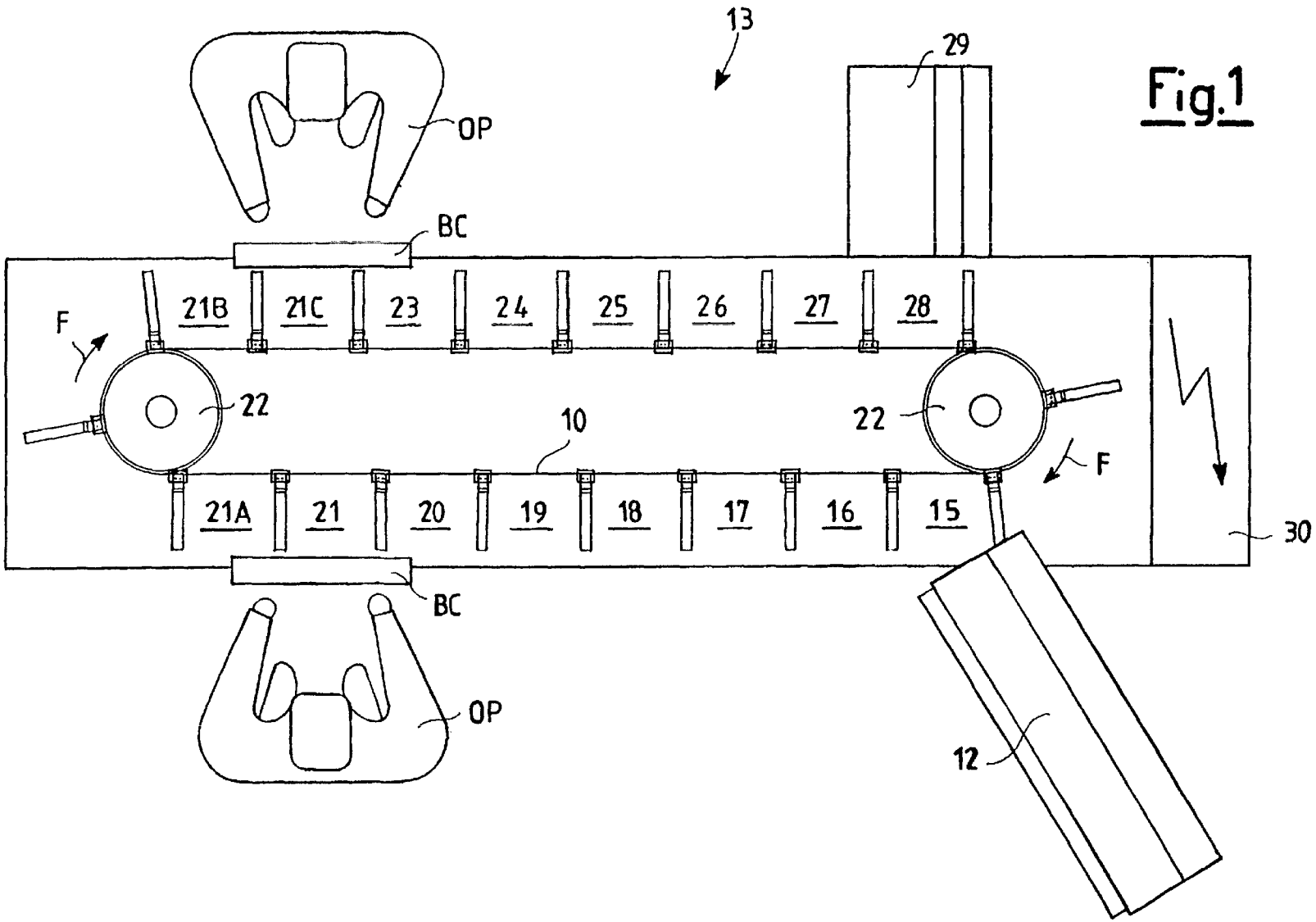
FIG. 1 represents, schematically and partially, a plan view of a line to transport and handle the containers of a vertical cartoning machine of the known type.

The container is collected from a magazine 12 of a series of blanks and then transported along the line 10, typically circular or elliptical in shape, by a plurality of supporting fingers 14 and restraining cross members 32, which are moved, by an electromechanical device 30 for movement, in the direction identified by the arrow F in FIG. 1, so that the carton 11 is presented at discontinuous and regular intervals in front of each pre-established station, where specific devices perform one or more pre-established operations, in order to insert the product into the package and close this package.

In particular, the blank that will form the container or carton 11, already appropriately pre-shaped according to the format required and still pressed and folded along its opposite sides L1, L2, is collected automatically from the blank magazine 12 and from here loaded onto the transport line 13 by the fingers 14, at the first station 15 for carton loading; in the station 15, using traditional mechanical devices, an operation to open the blank is performed by inserting a point or blade SP taken from a tool magazine MU into the blank and, subsequently, at the station 16, an operation is performed to fold the lower sides or tabs L3 of the container 11.

At the station 17 a dry, impressed or ink jet stamp is affixed, typically on the lower surface F1 of the carton 11 (especially in the case of pharmaceutical products), while at the subsequent station 18 an operation is performed to fold along the line G1 of the lower flap B1 of the carton 11.

In order to fit the lower flap or tongue B1 inside the container 11 and thus close the lower portion of the carton 11, at the station 19 in the line 13 another blade SP is placed in contact with the internal surface of the container 11, of a suitable size to aid inserting the lower tongue B1, which moves against the tabs L3, into the carton 11.

Subsequently, at the station 20, one or more leaflets or sheets illustrating the physicochemical or organoleptic properties of the product contained are inserted from above into the container 11, while sensor and detection devices are used to check that the illustrative leaflet, carton 11 selected and product to be inserted inside correspond exactly.

In fact, in at least one of the stations of the line 13 indicated with 21, 21A, 21B, 21C in FIG. 1 and located typically upstream or downstream of one of the snub pulleys 22 of the line 13, the product, which may be collected from the pallets BC loose or contained in turn inside bottles or blister packs, is inserted into the carton 11 either automatically or by an operator OP.

Downstream of a free station 23 in the line 13, available for any additional check or control processes, at the station 24 an operation to fold the upper sides or tabs L4 of the carton 11 is performed, followed by an operation to fold the upper flap or tongue B2 along the line G2 at the station 25, and lastly an operation to close the carton 11 definitively, by fitting the upper tongue B2 into the carton 11, against the tabs L4.

This insertion, as in the case of the lower flap B1, is aided by inserting a blade of an appropriate length inside the container 11; this blade is positioned in contact with one of the internal walls of the carton 11.

The operations described are implemented at the station indicated by 26 in FIG. 1. Subsequently, there is a station 27 to identify and reject defective cartons 11 (caused either by incorrect processes or if the product, leaflet and carton fail to correspond) and then a station 28 for storing filled and closed cartons, which are unloaded from the line 13 and stored in containing structures or magazines 29.

All movements described above are effected by means of a vertical loading cartoning machine designed according to the present invention, which, by means of appropriate electronic control equipment and an axes control system, allows any format of carton 11 within a vast range of measurements to be positioned and moved along the line 13, in a short time and automatically, simply by keying in on a keyboard the dimensions of the sides A, B, C and, if necessary, the width of the tongues B1, B2 of the carton 11.

The control equipment processes the set data and sends appropriate commands, either directly or through a PLC system, to the axes control system, which regulates the position and operation or all actuators, which are present in the various stations of the cartoning machine, in order to perform the previously mentioned operations to fold the blank and close the carton.

In particular, the electronic equipment utilised makes it possible to control positioning and operation, intended as the direction and speed of movement, of the electric or pneumatic actuators of the cartoning machine, which perform the operations to fold the blank, to hold the container in the required position, to move the pushing devices used to close the flaps of the carton and to place the containers in the magazines for storage and reject.

Moreover, it is possible to control the positioning and operation of devices to insert the illustrative leaflets and products into the carton, the positioning and movement of stamps or devices for printing bar codes and to process and check codes coherent with the product inserted in the carton and, lastly, positioning and operation and the replacement of pieces that can be collected from a pre-established series of tool magazines.

Moreover, an appropriate electronic control processor is used to appropriately manage the magazine 12 containing the blanks, the dimensions of which vary according to the format of the container required, the products magazine, the magazine 29 for processed pieces and rejects, productivity and to store in a file or print data relevant to the products of a specific customer.

Figure 2:
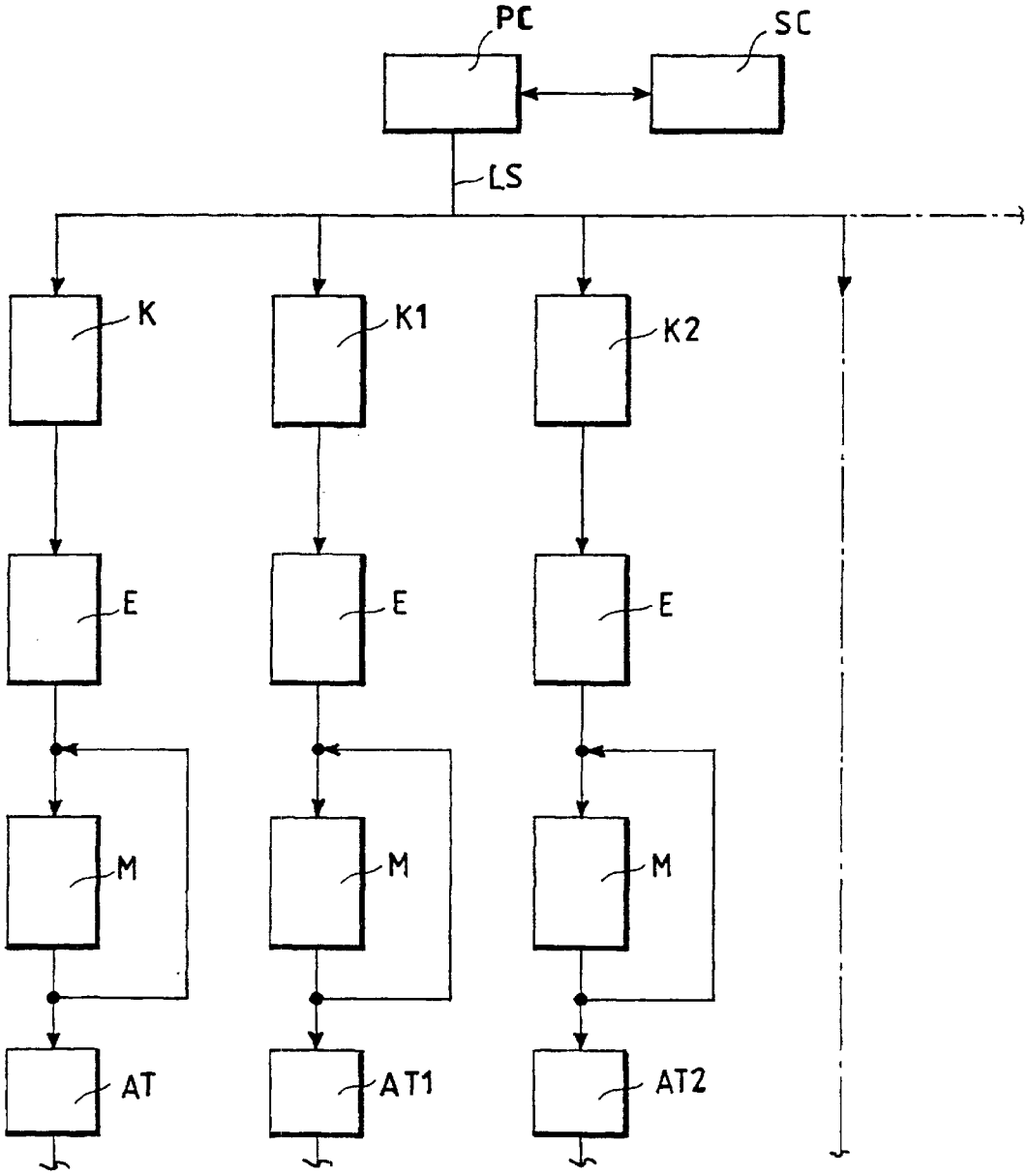
FIG. 2 is a block diagram of an electronic system for processing and controlling the axes of an automatic machine for packaging products inside containers, according to the invention.

In relation to this, in a preferred although unlimiting example of the form of implementation of the present invention, an axes control system is implemented by means of electronic equipment as illustrated in the block diagram in FIG. 2, in which, for each actuator AT AT1, AT2 present on the cartoning machine an electronic board K, K1, K2 . . . is provided, supplied with alternate current at 24 volts, which, by means of a serial line LS of the type 485, receives the information concerning the positions that each actuator AT, AT1, AT2 . . . must assume from a PC electronic processor, according to the dimensions of the sides A, B, C of the container or carton 11 to be processed (depending on the particular format being processed) and according to the positions assumed by the aforesaid actuators AT, AT1, AT2 . . . in the moments immediately before.

Moreover, a specific data-base allows a drawing of the container 11 to be represented on PC processor monitor, in order to further aid the operator during the operation of entering data using the keyboard.

Each actuator AT, AT1, AT2 . . . is connected to a corresponding drive motor M (brushless or cylinder), which in turn is retroactivated in a closed loop circuit and connected to a relevant encoder E; the PC electronic processor can also control a stepping motor, an electric motor or a series of gears or worm screws, which move cams, moved in turn by one of the aforesaid motors, in order to cause the aforesaid movements of the actuators.

At the moment in which all the actuators AT, AT1, AT2 . . . are positioned, according to the methods described previously, the serial line LS dialogues with the control system SC ("PLC" type), which manages movement of the entire machine, electronically controlling the speed of the supporting devices 14, by reading the signals from sensors, interfaces, buttons and photocells present in the various equipments of each station in the line 13.

Therefore, when the machine is switched on, the cartons 11 follow the route identified with 10 in FIG. 1 and, for each single step, the control system SC reads the bar code printed on the container in order to send, either directly or by means of a "driver", a control to enable the subsequent movement if the container, product contained and illustrative leaflet inserted correspond.

Finally, the PC electronic processor performs the function of general "master" for the movement of the actuators AT, AT1, AT2 . . . ; moreover, it manages the speed of the machine and intervals between each step and enables the PLC to move the containers between the various stations when all safety conditions are verified.

Lastly, it is capable of identifying each carton 11, by memorising the associated bar code and can manage the magazines for blanks, finished products and rejects, the values regarding productivity and information regarding the cartons and products of a specific customer, which can be printed or grouped in archive files.

On the other hand, the control system SC directly controls movement of the cartons 11 by means of a sequence of discontinuous steps.

In this way, for example, depending on the dimensions of the carton, the loading station 15 is automatically loaded, by means of a pushing device, with a group of blanks with the required format, after these have been selected from a magazine.

Moreover, depending on the format of carton set, at the same station 15, the control system SC feeds the motor M, so that it moves the pushing device ST with an alternate rectilinear movement; this is activated, according to the command received, at the moment in which the previously set group of blades SP from the mobile tool magazine MU is in front of it, as it is suitable for use with containers 11 with a pre-established height C.

This operation is clearly illustrated in FIG. 3. Similarly, depending on the format of the carton 11, other operations are performed to open the blank and fold the tabs and flaps of the carton 11, to stamp or print the bar code (for example, by means of a series of circular rotating stamps TC, positioned fixed to a rotating platform PT, as illustrated schematically in FIG. 4), to insert the illustrative leaflets and to check the codes.

Lastly, movements on the level or in space (with two or three axes) of the various parts used to process the carton 11 are preferably obtained using linear units with belt drive, in the versions with single or dual carriage, suitably coupled and connected to one another, in order to satisfy all requirements of length and travel; inside each head of the load-bearing profile of the linear unit is a pulley with a hollow shaft and tang seat for connection with a motor and relevant motion reduction unit, an interface plate or other control part.

With regard to this, for example, a movement with two axes can be obtained by means of a so-called portal structure of the aforesaid linear units, in which movement of the X axis is obtained utilising a pair of linear units in parallel, synchronised by means of a countershaft coaxial to the motor, while the Y axis is formed of a linear unit fitted perpendicular to the other linear unit and connected by interface plates.

The characteristics of the automatic machine for packaging products inside containers, which is the subject matter of this invention, become clear from the description, as do the resulting advantages.

In particular, these are represented by:

- the possibility to operate indifferently in lines with 100 to 100,000 cartons of variable formats;
- complete automation and automatic positioning of the various actuator mechanisms by means of electronic control of a plurality of axes (up to 55 axes);
- management and control of the work in progress;
- magazine management with printout of work performed, delivery batches divided both according to customer and according to product, by means of a compatible database;

control of the effective presence of a carton in the line;

control, by means of an optical system, of coherence between the carton being processed and the illustrative leaflet contained inside with check that this has actually been inserted into the carton;

control of the effective insertion of the relevant product inside the carton;

possibility to impress a bar code and print by impression or ink-jet the expiry date of the relevant product or batch;

possibility to change the format of the carton from one with minimum overall dimensions to one with maximum overall dimensions in an extremely short time (around 10 seconds) and automatically, simply by keying in the dimensions of the sides of the carton using a keyboard.

Finally, it is obvious that numerous variants can be effected to the automatic machine for packaging products inside containers, in particular to the vertical loading cartoning machine, which is the subject-matter of the present invention, without deviating from the principles of intrinsic novelty of the inventive idea. It is also obvious that, in the practical implementation of the invention, the materials, forms and dimensions of the details illustrated may vary according to requirements and these may be replaced by others that are technically equivalent.

What is claimed is:

1. An automatic machine for packaging products inside containers or cartons (11), comprising a plurality of stations (15–21, 21A, 21B, 21C, 23–28) in a line (13), at each of which at least one operation to package the products is performed, by means of actuators (AT, AT1, AT2. . .), starting from at least one blank, which is collected from a magazine (12), conveyed to a loading station (15) and transferred, according to a pre-established route (10), from one station to a next station, before being unloaded at specific reject (27) or storage (28) stations, wherein said actuators (AT, AT1, AT2. . .) are managed by an electronic axes control system, which automatically regulates positioning and movement of said actuators (AT, AT1, AT2. . .), on the basis of information relevant to at least one dimension (A, B, C) of said carton (11), which is set by an operator (OP) on an electronic processor (PC) of said axes control system, in order to allow format of said carton (11) to be changed from a pre-established minimum value to a maximum value of overall dimensions of said carton (11) automatically, wherein said actuators (AT AT1, AT2) comprise pushing devices for said blanks and said cartons (11), inserting devices for products and illustrative leaflets, stamping devices (PT, TC) and devices for generating and printing bar codes on said cartons (11), devices to detect and process coherent codes, equipment (ST) for replacing blades (SP) that can be collected from a tool magazine (MU) and wherein said actuators (AT, AT1, AT2) move in relation to the size of said carton (11) being constructed.

2. The automatic machine for packaging products according to claim 1, wherein said axes control system manages said positioning and movement of said actuators (AT, AT1, AT2. . .), thereby controlling a series of operations to fold a blank, closing said cartons (11).

3. The automatic machine for packaging products according to claim 1, wherein said axes control system comprises at least one electronic board (K, K1, K2. . .), which receives from said electronic processor (PC), through at least one serial line (LS), a series of information relevant to at least one dimension (A, B, C) of said carton (11) and to positions of said actuators (AT, AT1, AT2. . .) in intervals of time prior to said information being set, wherein said electronic board (K, K1, K2. . .) being connected to a mechanism (M) of at least one of said actuators (AT, AT1, AT2. . .).

4. The automatic machine for packaging products according to claim 3, wherein said mechanism (M) comprises electric motors or mechanical devices driven by said electric motors, said motors being provided with at least one encoder and being controlled in retroaction, by means of at least one closed loop retroaction circuit.

5. The automatic machine for packaging products according to claim 3, wherein subsequent to said positioning of the actuators (AT, AT1, AT2. . .), said serial line (LS) dialogues with a PLC electronic control system (SC), which manages, either directly or through a driver, operation of said actuators (AT, AT1, AT2. . .) and a sequence of steps required to move said cartons (11) in said line (13).

6. The automatic machine for packaging products according to claim 5, wherein said PLC electronic control system (SC) manages and controls the works in progress, manages magazines (12, 29, MU) and printout of works performed and delivery batches, divided both according to customer and product, through a compatible database, wherein SC further controls effective presence of cartons (11) in said line (13), controls coherence between carton (11), product and illustrative leaflets, checks that said leaflet has been inserted into said carton (11) and regulates stamping operations to allow cartons (11) of different formats to be processed in said line (13).

7. The automatic machine for packaging products according to claim 1, further comprising an automatic vertical loading cartoning machine for packaging products inside cartons (11).

* * * * *